US006595331B2

(12) United States Patent
Moncini

(10) Patent No.: US 6,595,331 B2
(45) **Date of Patent: *Jul. 22, 2003**

(54) BRACKET FOR SECURING ELEVATOR COMPONENTS

(75) Inventor: Raymond Moncini, Southington, CT (US)

(73) Assignee: Otis Elevator Company, Farmington, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/407,032

(22) Filed: Sep. 27, 1999

(65) Prior Publication Data

US 2002/0079169 A1 Jun. 27, 2002

(51) Int. Cl.[7] ..... B66B 7/00; B66B 7/08
(52) U.S. Cl. ..... 187/408; 187/266; 187/411
(58) Field of Search ..... 187/406, 408, 187/411, 262, 266; 52/30

(56) References Cited

U.S. PATENT DOCUMENTS

| | | | | | |
|---|---|---|---|---|---|
| 4,079,817 | A | * | 3/1978 | Todato et al. | 187/408 |
| 4,664,230 | A | * | 5/1987 | Olsen | 187/255 |
| 4,848,519 | A | * | 7/1989 | Ericson et al. | 187/272 |
| 4,977,983 | A | * | 12/1990 | Garrido et al. | 187/408 |
| 5,127,493 | A | * | 7/1992 | Yasuda et al. | 187/251 |
| 5,353,893 | A | * | 10/1994 | Sun et al. | 187/412 |
| 5,429,211 | A | * | 7/1995 | Aulanko et al. | 187/254 |
| 5,520,264 | A | * | 5/1996 | Korhonen | 187/408 |
| 5,878,847 | A | * | 3/1999 | Mustalahti et al. | 187/266 |
| 5,899,300 | A | * | 5/1999 | Miller et al. | 187/266 |
| 6,196,356 | B1 | * | 3/2001 | Sneed | 187/408 |

FOREIGN PATENT DOCUMENTS

| | | | | |
|---|---|---|---|---|
| EP | 000372574 | * | 6/1990 | 187/406 |
| FR | 2624491 | * | 4/1992 | 187/408 |
| JP | 402158586 | * | 6/1990 | 187/408 |
| JP | 404112176 | * | 4/1992 | 187/411 |
| JP | 410087215 | * | 4/1998 | |
| JP | 411029277 | * | 2/1999 | |
| JP | 2000016716 | * | 1/2000 | |
| JP | 2001097652 | * | 4/2001 | |
| WO | WO9948789 | | 9/1999 | |

* cited by examiner

*Primary Examiner*—Christopher P. Ellis
*Assistant Examiner*—Paul T. Chin

(57) ABSTRACT

An elevator component mounting system includes one or more bracket-beam type structures that spans the vertical distance between successive floor slabs to provide a support bracket for elevator components in the absence of a vertical wall spanning the floor slabs. The bracket-beam structure is suitable for mounting dead-end rope hitches, elevator machines and other components.

13 Claims, 1 Drawing Sheet

BRACKET FOR SECURING ELEVATOR COMPONENTS

TECHNICAL FIELD

The present invention relates to elevator systems and, more particularly, to a bracket for securing elevator components, such as dead-end hitches, to a hoistway having limited wall area available for attachment.

BACKGROUND OF THE INVENTION

Elevator systems are typically installed in vertical hoistways within buildings having structural characteristics particularly dimensioned and designed to accommodate the elevator system components. Such customized design and structure are costly and space-consuming. In addition, permanent structures cannot be easily or inexpensively altered and, thus, replacement options for old or damaged elevator equipment are limited. Additionally, such permanent structures sometimes prohibit convenient access to various elevator components for servicing or repair.

Most elevator component mounting devices for mounting in the hoistway require an available section of hoistway wall spanning successive floor slabs to support mounting. It is desirable in many building structures, however, to forego constructing such wall spans unless necessary.

OBJECTS AND SUMMARY OF THE INVENTION

It is an object of the present invention to provide an elevator component mounting system that enables an elevator system to be installed in a building that does not require costly or space-consuming structural characteristics.

It is another object of the present invention to provide an elevator component mounting system that is versatile with respect to its interfacing with different building structures and with different elevator components.

It is another object of the present invention to provide an elevator component mounting system that spans successive floor slabs and does not require a continuous hoistway wall span to support it.

It is yet another object of the present invention to provide an elevator component mounting system that facilitates convenient access to various elevator components for servicing or repair.

These objects and others are achieved by the present invention mounting system disclosed herein.

The present invention elevator component mounting system is directed to one or more bracket-beam type structures that span the vertical distance between successive floor slabs to provide a support bracket for elevator components in the absence of a vertical wall spanning the floor slabs. The bracket-beam structure according to the present invention is suitable for mounting dead-end rope hitches, elevator machines and other components. In the preferred embodiment, the present invention is described with respect to a system that includes two bracket-beam structures on opposite sides of a hoistway wherein each bracket-beam structure supports a rope dead-end hitch and one bracket-beam structure supports an elevator machine.

DESCRIPTION OF THE PREFERRED EMBODIMENT

Figures 1, 2:
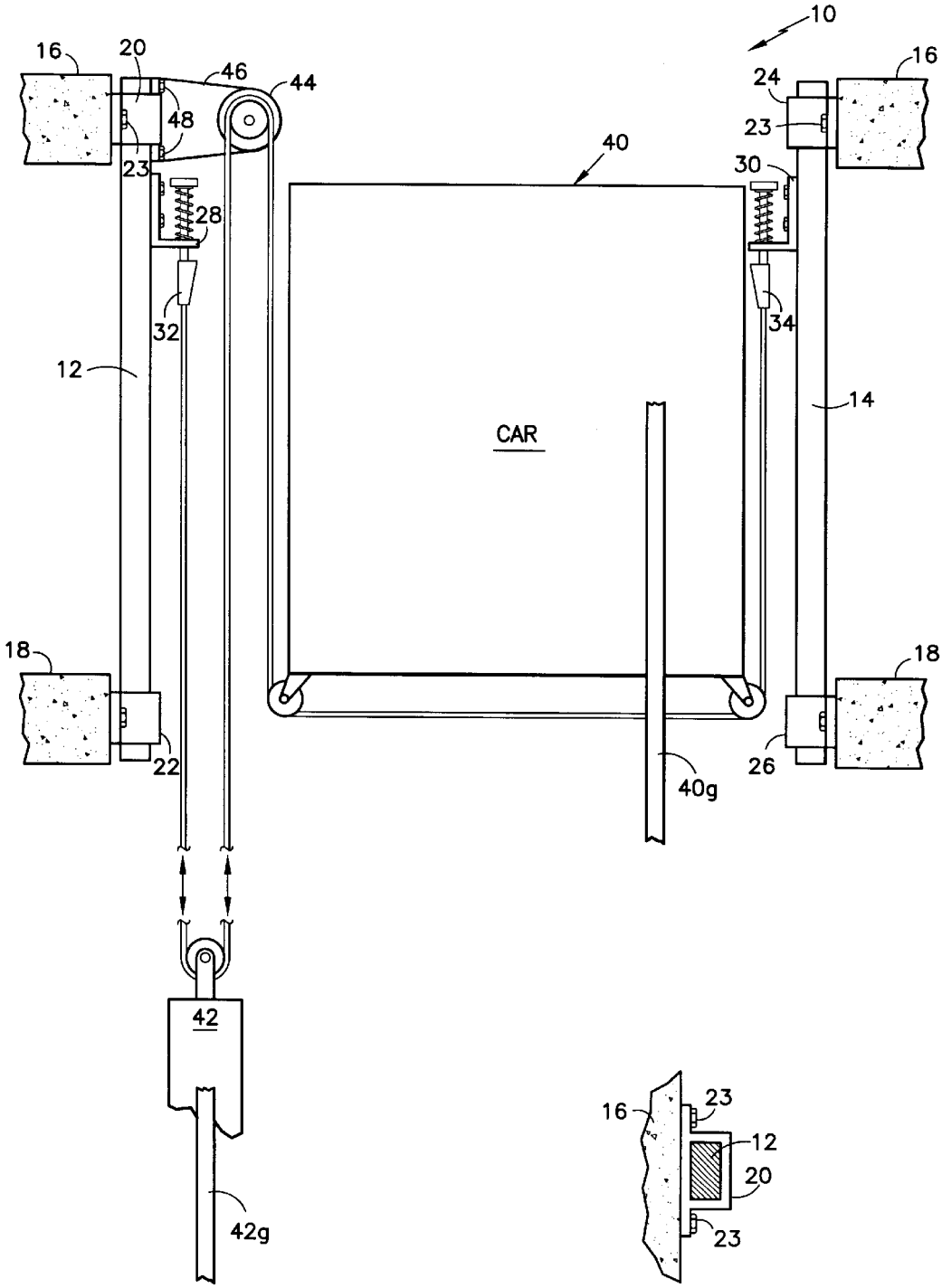
FIG. 1 partial, schematic side view of a preferred embodiment an elevator component support system according to the present invention shown supporting rope dead-end hitches and an elevator machine.
FIG. 2 is a partial, schematic, top cross-sectional view of a component of the embodiment shown in FIG. 1.

A preferred embodiment of the present invention elevator component supporting system (10) includes a first beam (12) and a second beam (14). Each beam (12, 14) is an elongated, rigid member that may have any one of a variety of cross-sectional shapes such as rectangular, as shown in FIG. 2. Each beam (12, l4) is attached to an upper and lower floor slab (16, 18, respectively) representing two successive floors in a building structure. The first beam (12) is attached to the floor slabs (16,18) by a set of upper and lower brackets (20, 22) that may be attached to the floor slabs (16, 18) by bolts (23). The second beam (14) is attached to the floor slabs (16,18) by a set of upper and lower brackets (24, 26) that may be attached to the floor slabs (16, 18) by bolts (23).

A variety of elevator components may be attached to the beams (12, 14) of the present invention. In the preferred embodiment, rope dead-end hitch plates (28, 30) may be attached, respectively, to the beams (12, 14) as shown in FIG. 1. The hitch-plates (28, 30) anchor rope terminations (32, 34) for elevator ropes (36) that, as shown, suspend an elevator car (40) and a counterweight (42) for movement along guide rails (40g, 42g). (One of each pair of guide rails (40g, 42g) is partially, schematically illustrated FIG. 1 in an exemplary location. The other of each pair, which extend vertically through the entire range of motion of the car (40) and counterweight (42), are disposed directly on the opposite side of the car (40) and counterweight (42), respectively. The details and location of the guide rails is not essential to the understanding of the subject invention, and in practice the guide rails could be configured and located in any conventional manner in the hoistway.) An elevator machine (44) is mounted to the first beam (12) through its machine bracket (46) that is attached with bolts (48) to the first beam (12).

What is claimed is:

1. An elevator system within an elevator hoistway including at least two vertically-spaced structural building members, said system comprising an elevator car riding along a car guide rail;

a counterweight riding along a counterweight guide rail;

an elevator rope suspending the elevator car and the counterweight for movement in the hoistway;

a first elongated, rigid member separate from the guide rails along which the car and counterweight ride and having a first end and a second end;

first rigid member attachment means proximate each of said first and second ends of said first rigid member for attaching said first rigid member to two of said vertically-spaced structural building members, respectively, so that said first rigid member extends across a span between said two vertically-spaced structural members;

a second elongated, rigid member separate from the guide rails along which the car and counterweight ride and having a first end and a second end;

second rigid member attachment means proximate each of said first and second ends of said second rigid member for attaching said second rigid member to a pair of said vertically-spaced structural building members, respectively, so that said second rigid member extends across a span between said pair of vertically-spaced structural members; and rope hitch attachment means on each of said first and said second rigid members for attaching the ends of said elevator rope to each of said first and said second rigid members, respectively.

2. A system according to claim 1, further comprising elevator machine mounting means for mounting an elevator machine to said first rigid member.

3. An elevator system disposed in a hoistway that extends vertically through a plurality of support slabs that are vertically spaced from one another, the elevator system including:

a car moving within a hoistway and riding along a car guide rail;

a counterweight moving within a hoistway and riding along a counterweight guide rail;

one or more ropes engaged with the car and counterweight to carry the load of the car and counterweight such that tension is produced in the ropes; and a support assembly, separate from the guide rails along which the car and counterweight ride, engaged with the one or more ropes and attached to one or more of the support slabs to transfer the tension from the ropes to the one or more support slabs.

4. An elevator system according to claim 3, wherein the one or more ropes have at least one end that is attached to the support assembly.

5. An elevator system according to claim 3, further including a machine engaged with the ropes to drive the car through the hoistway, wherein the machine is attached to the support assembly such that the tension load in the ropes are passed through the machine and to the support assembly.

6. An elevator system according to claim 3, wherein the support assembly includes a member extending between vertically spaced support slabs such that loads are shared between the support slabs.

7. The elevator system according to claim 3, wherein said support assembly comprises:

a first elongated, rigid member having a first end and a second end; and attachment means proximate each of said first and second ends for attaching said first rigid member to two of said support slabs, so that said first rigid member extends across a span between said two support slabs.

8. The elevator system according to claim 7, further comprising rope hitch attachment means for attaching an elevator rope end to said first rigid member.

9. The elevator system according to claim 7, further comprising elevator machine mounting means for mounting and elevator machine to said first rigid member.

10. The elevator system according to claim 7, wherein said support assembly further comprises:

a second elongated, rigid member having a first end and a second end; and attachment means proximate each of said first and second ends of said second rigid member for attaching said second rigid member to a pair of said support slabs, so that said second rigid member extends across a span between said pair of support slabs.

11. The elevator system according to claim 10, wherein said first elongated, rigid member and said second rigid member are positioned opposite from each other, at generally the same vertical position, within said elevator hoistway.

12. The elevator system according to claim 10, further comprising elevator machine mounting means for mounting an elevator machine to said first rigid member.

13. The elevator system according to claim 10, further comprising rope hitch attachment means associated with each of said first and said second rigid members for attaching an elevator rope end to each of said first and said second rigid members, respectively.

* * * * *